US008688542B2

(12) United States Patent
Besharati et al.

(10) Patent No.: US 8,688,542 B2
(45) **Date of Patent: *Apr. 1, 2014**

(54) METHOD, SYSTEM AND APPARATUS FOR MANAGING A BID TRACKING DATABASE

(71) Applicant: Research In Motion Limited, Waterloo (CA)

(72) Inventors: Jalal Besharati, Plantation, FL (US); Ankur Aggarwal, Santa Clara, CA (US)

(73) Assignee: BlackBerry Limited, Waterloo, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/858,721

(22) Filed: Apr. 8, 2013

(65) Prior Publication Data

US 2013/0232025 A1 Sep. 5, 2013

Related U.S. Application Data

(63) Continuation of application No. 12/621,282, filed on Nov. 18, 2009, now Pat. No. 8,417,583.

(51) Int. Cl.
*G06Q 30/00* (2012.01)

(52) U.S. Cl.
USPC ..... 705/26.35

(58) Field of Classification Search
USPC ..... 705/26.1–27.2
See application file for complete search history.

(56) References Cited

U.S. PATENT DOCUMENTS

| | | | | |
|---|---|---|---|---|
| 6,055,518 | A | 4/2000 | Franklin et al. | |
| 6,944,599 | B1 | 9/2005 | Vogel et al. | |
| 7,739,154 | B1 | 6/2010 | Asher | |
| 8,417,583 | B2 * | 4/2013 | Besharati et al. | 705/26.35 |
| 2001/0049654 | A1 | 12/2001 | Cecchetti et al. | |
| 2002/0013761 | A1 | 1/2002 | Bundy et al. | |
| 2003/0033236 | A1 * | 2/2003 | Davenport et al. | 705/37 |
| 2003/0216971 | A1 | 11/2003 | Sick et al. | |
| 2005/0273803 | A1 | 12/2005 | Takagi et al. | |
| 2007/0226118 | A1 * | 9/2007 | Gill | 705/37 |

(Continued)

FOREIGN PATENT DOCUMENTS

CA 2720910 A1 5/2011

OTHER PUBLICATIONS

"U.S. Appl. No. 12/621,282, Non Final Office Action mailed Aug. 16, 2012", 11 pgs.

(Continued)

*Primary Examiner* — Jason Dunham
*Assistant Examiner* — Ethan D Civan
(74) *Attorney, Agent, or Firm* — Schwegman Lundberg & Woessner, P.A.

(57) ABSTRACT

Method and system to manage a bid tracking database are disclosed herein. At least one bid record is received at an interface, the at least one bid record comprising a bid price, a bid timestamp, and a bid item identifier. Receiving at least one auction record at the interface, the at least one auction record comprising a winning price, an end timestamp, and an auction item identifier corresponding to the bid item identifier. Maintaining the at least one bid record and the at least one auction record in a memory. Determining whether the bid price matches or exceeds the winning price and whether the bid timestamp matches the end timestamp. When the determination is affirmative, writing the bid record to the bid tracking database maintained in the memory.

20 Claims, 5 Drawing Sheets

(56) References Cited

U.S. PATENT DOCUMENTS

| | | | | |
|---|---|---|---|---|
| 2008/0016007 | A1* | 1/2008 | Erisman | 705/80 |
| 2008/0167886 | A1 | 7/2008 | De Marcken | |
| 2009/0018942 | A1 | 1/2009 | Hamman et al. | |
| 2009/0106196 | A1 | 4/2009 | Gutlapalli et al. | |
| 2009/0106216 | A1 | 4/2009 | Gutlapalli et al. | |
| 2009/0106324 | A1 | 4/2009 | Gutlapalli et al. | |
| 2009/0106325 | A1 | 4/2009 | Gutlapalli et al. | |
| 2011/0119146 | A1 | 5/2011 | Besharati et al. | |
| 2012/0047042 | A2 | 2/2012 | Besharati et al. | |

OTHER PUBLICATIONS

"U.S. Appl. No. 12/621,282, Notice of Allowance mailed Dec. 11, 2012", 9 pgs.
"U.S. Appl. No. 12/621,282, Response filed Nov. 16, 2012 to Non-Final Office Action mailed Aug. 16, 2012", 9 pgs.
"BidNet Announces Online Service for Tracking State/Local Bid Invitations", Information Today vol. 6, Iss. 11, p. 3-3, (Dec. 1, 1989), 1 page.
"U.S. Appl. No. 12/621,282, Final Office Action mailed Jul. 25, 2011", 11 pgs.
"U.S. Appl. No. 12/621,282, Final Office Action mailed Dec. 20, 2010", 12 pgs.
"U.S. Appl. No. 12/621,282, Non Final Office Action mailed Mar. 7, 2011", 11 pgs.
"U.S. Appl. No. 12/621,282, Non Final Office Action mailed Sep. 10, 2010", 9 pgs.
"U.S. Appl. No. 12/621,282, Response filed Feb. 18, 2011 to Final Office Action mailed Dec. 20, 2010", 9 pgs.
"U.S. Appl. No. 12/621,282, Response filed Jun. 7, 2011 to Non Final Office Action mailed Mar. 7, 2011", 12 pgs.
"U.S. Appl. No. 12/621,282, Response filed Sep. 26, 2011 to Final Office Action mailed Jul. 25, 2011", 11 pgs.
"U.S. Appl. No. 12/621,282, Response filed Dec. 2, 2010 to Non Final Office Action mailed Sep. 10, 2010", 7 pgs.
"European Application Serial No. 09176410.0, Extended European Search Report mailed Apr. 8, 2010", 5 pgs.
"European Application Serial No. 09176410.0, Response filed Jun. 7, 2010 to Search Report mailed Apr. 8, 2010", 14 pgs.

* cited by examiner

200

| Item ID | Bid Price | Time |
|---|---|---|
| 12345 | $70.00 | 14:30:01 |

202 204 206

250

| Item ID | Current Price | Time | Winning Price | End Time |
|---|---|---|---|---|
| 12345 | $72.00 | 14:35:10 | $72.00 | 14:35:10 |

252 254 256 258 260

Figure 2

316

| Item ID | Bid Price | Time |
|---|---|---|
| 12345 | $70.00 | 14:30:01 |
| 24473 | $125.00 | 08:10:00 |
| 55682 | $0.08 | 15:05:30 |
| 55682 | $0.54 | 15:08:00 |
| 11849 | $11.15 | 20:01:00 |
| 12345 | $72.00 | 14:35:10 |

318

| Item ID |
|---|
| 12345 |
| 24473 |
| 55682 |
| 11849 |

320

| Item ID | Current Price | Time | Winning Price | End Time |
|---|---|---|---|---|
| 12345 | $72.00 | 14:35:10 | $72.00 | 14:35:10 |
| 24473 | $125.00 | 08:10:00 | | |
| 55682 | $0.54 | 15:08:00 | | |
| 11849 | $11.15 | 20:01:00 | | |

Figure 5

METHOD, SYSTEM AND APPARATUS FOR MANAGING A BID TRACKING DATABASE

PRIORITY APPLICATION

This application is a continuation of U.S. application Ser. No. 12/621,282, filed Nov. 18, 2009, which is incorporated herein by reference in its entirety.

FIELD

The specification relates generally to bid tracking, and specifically to a method, system and apparatus for managing a bid tracking database.

BACKGROUND

A variety of electronic devices, including, for example, personal computers and smart telephones, can have the capability to interact with online auction services. Some such devices can interact with online auction services to place and review bids by way of a conventional web browser. Some devices can also interact with online auction services by way of other applications running on those devices. The variability in interactions with online auction services can complicate the collection of data concerning the use of online auction services.

BRIEF DESCRIPTIONS OF THE DRAWINGS

Embodiments are described with reference to the following figures, in which:

FIG. 2 depicts a bid record and an auction record maintained within components of the system of FIG. 1, according to a non-limiting embodiment;

FIG. 5 depicts received bid records, a list of item identifiers and received auction records, according to a non-limiting embodiment.

DETAILED DESCRIPTION OF THE EMBODIMENTS

An aspect of the specification can provide a method of managing a bid tracking database comprising: receiving at least one bid record at an interface, the at least one bid record comprising a bid price, a bid timestamp and a bid item identifier; receiving at least one auction record at the interface, the at least one auction record comprising a winning price, an end timestamp and an auction item identifier corresponding to the bid item identifier; maintaining the at least one bid record and the at least one auction record in a memory; determining whether the bid price matches or exceeds the winning price and whether the bid timestamp matches the end timestamp; and, when the determination is affirmative, writing the bid record to the bid tracking database maintained in the memory. A computer readable storage medium for storing computer readable instructions for execution by a processor, the computer readable instructions implementing the method can also be provided.

Another aspect of the specification can provide a server comprising: an interface for receiving at least one bid record comprising a bid price, a bid timestamp and a bid item identifier; and for receiving at least one auction record comprising a winning price, an end timestamp and an auction item identifier corresponding to the bid item identifier; a memory for maintaining the at least one bid record and the at least one auction record, and for maintaining a bid tracking database; and a processor interconnected with the interface and the memory, the processor configured to receive the at least one bid record and the at least one auction record from the interface; the processor further configured to determine whether the bid price matches or exceeds the winning price and whether the bid timestamp matches the end timestamp; the processor further configured to, when the determination is affirmative, write the bid record to the bid tracking database maintained in the memory.

Figure 1:
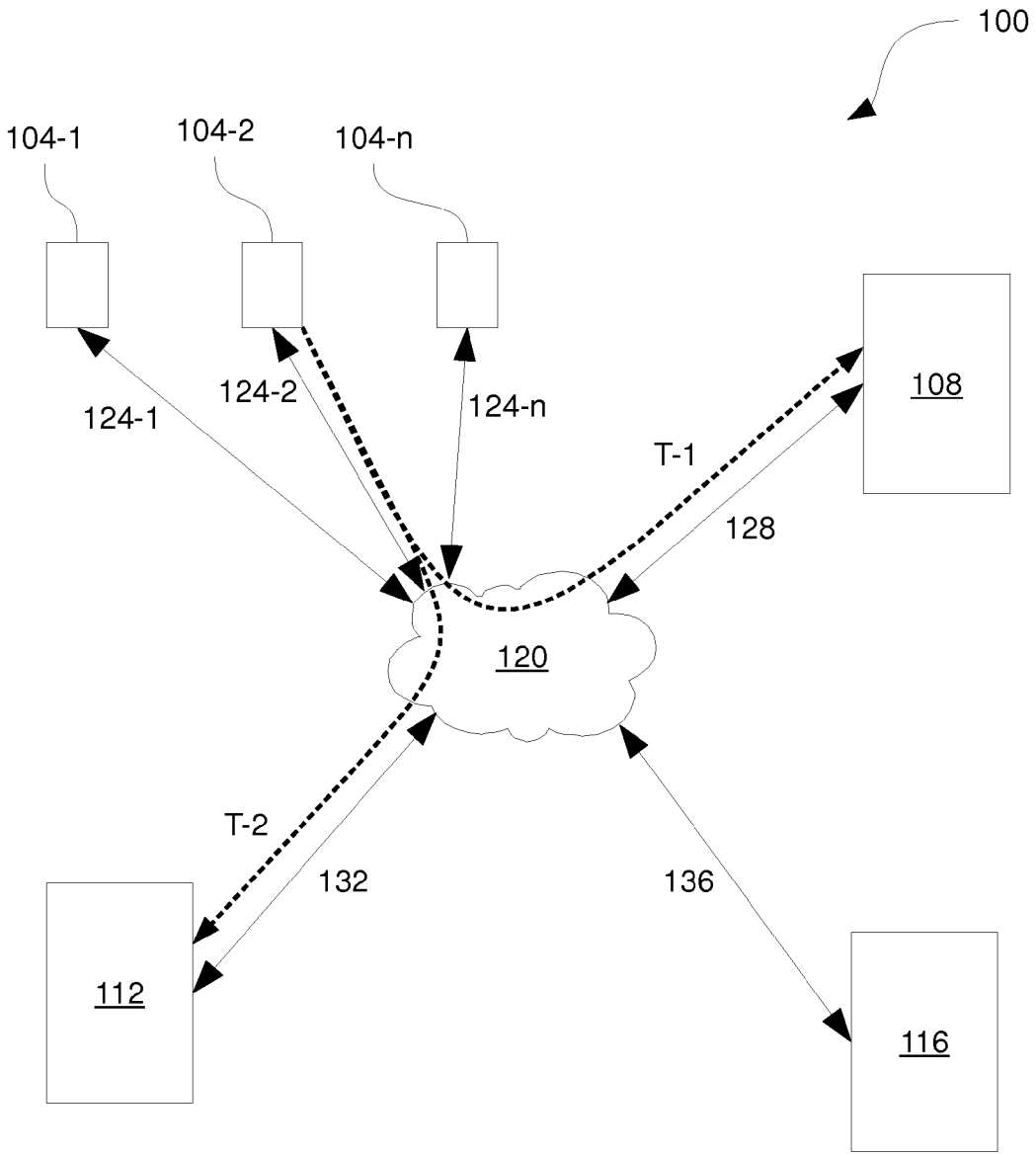
FIG. 1 depicts a schematic representation of a system for managing a bid tracking database, according to a non-limiting embodiment.

FIG. 1 depicts a system 100 comprising a plurality of mobile electronic devices 104-1, 104-2 . . . **104-*n* (referred to collectively as mobile electronic devices 104 and generically as a mobile electronic device 104), a first server 108, a second server 112 and a third server 116. Mobile electronic devices 104 and servers 108, 112 and 116 can be interconnected via a network 120 and links therewith. Mobile electronic devices 104 can be connected with network 120 via links 124-1, 124-2 . . . 124-*n*. Server 108 can be connected with network 120 via link 128, server 112 can be connected with network 120 via link 132 and server 116 can be connected with network 120 via link 136**.

Mobile electronic devices 104 can be devices based on the computing environment and functionality of hand-held wireless communication devices. It will now be apparent, however, that mobile electronic devices 104 are not limited to hand-held wireless communication devices. Other mobile electronic devices are also contemplated, such as cellular telephones, smart telephones, media players and laptop computers.

Network 120 can comprise any suitable combination of wired and/or wireless networks, including but not limited to packet based networks, the Internet, analog networks, the PSTN, LAN, WAN, cell phone networks, WiFi networks, WiMax networks and/or any suitable combination thereof. Other suitable types of networks will also occur to those skilled in the art.

Links 124, 128, 132 and 136 can therefore be wireless or wired links, or combinations of wireless and wired links. For instance, links 124 can be wireless links based on core mobile network infrastructure (e.g. Global System for Mobile communications ("GSM"); Code Division Multiple Access ("CDMA"); CDMA 2000; 3G; 4G). Links 124 can also be based on wireless local area network ("WLAN") infrastructures such as the Institute for Electrical and Electronic Engineers ("IEEE") 802.11 Standard (and its variants), Bluetooth or the like, or hybrids thereof.

In general, servers 108, 112 and 116 can be based on any server environment that will occur to those skilled in the art, each including a module housing one or more central processing units, volatile memory (e.g. random access memory), persistent memory (e.g. hard disk devices) and network interfaces to allow servers 108, 112 and 116 to communicate over network 120.

Server 108 can host an auction website. Server 108 can therefore be configured to maintain in memory a plurality of auction records each comprising data concerning a particular auction, and to receive bids on items represented by the auction records and maintain the received bids in memory. It will now be apparent to those skilled in the art that a variety of configurations are possible for server 108, and that the structure of server 108 is not particularly limited herein. In system 100, mobile electronic devices 104 can be configured, for example via execution of an auction application on each mobile electronic device 104, to transmit bid records to server 108. An exemplary transmission T-1 of a bid record from mobile electronic device 104-2 to server 108 via link 124-2, network 120 and link 128 is shown in FIG. 1.

Mobile electronic devices 104 can also be configured, via execution of the auction application, to also transmit to second server 112 each bid record sent to server 108. Second server 112 can be a data collection centre, and can be operated by a different entity than the entity which operates first server 108, though this is not strictly necessary (that is, first and second servers 108 and 112 can be operated by the same entity in some embodiments). An exemplary transmission T-2 is shown in FIG. 1, comprising a transmission of the bid record of T-1 from mobile electronic device 104-2 to server 112 via link 124-2, network 120 and link 132. Transmissions T-1 and T-2 can be substantially simultaneous in some embodiments, though this is not strictly necessary. In other embodiments, transmission T-2 can be made, for example, once the success of transmission T-1 has been confirmed. It will be appreciated that in the present embodiment, transmissions T-1 and T-2 need not be identical. For example, transmission T-1 can additionally contain an identifier for mobile electronic device 104-2 (which can be incorporated within the bid record), whereas transmission T-2 can omit any such identifier.

Turning now to FIG. 2, an exemplary bid record 200 as stored in memory at second server 112 is shown. Also shown is an exemplary auction record 250 as maintained in memory at first server 108. Bid record 200 can comprise an item identifier 202, a bid price 204 and a timestamp 206. Item identifier 202 can be a string of characters identifying the item to which bid record 200 relates. In general, item identifier 202 can be chosen to uniquely identify a particular item for which an auction is being conducted at server 108 from the other items for which auctions are being conducted. Many suitable item identifiers will occur to those skilled in the art. In the present embodiment, item identifier 202 comprises an item number, "12345." Bid price 204 comprises the price being submitted to server 108 for item number 12345 by way of transmission of bid record 200. As shown in FIG. 2, bid price 206 indicates that mobile device 104-2 has transmitted a bid of seventy dollars for item number 12345 to server 108 and server 112. Timestamp 206 represents the time at which the bid was transmitted.

Auction record 250 comprises an auction item identifier 252. Similarly to item identifier 202, auction item identifier 252 can be chosen to uniquely identify a particular item for which an auction is being conducted at server 108. Auction record 250 also comprises a current price 254 and a timestamp 256. Current price 254 can contain the current highest bid for the auction represented by auction record 250. Timestamp 256 can contain the time at which the current highest bid was placed. Auction record 250 can also comprises a winning price 258, which contains the final bid price that ended the auction for item 12345. Auction record 250 also comprises an end timestamp 260, which indicates the time at which the auction for item number 12345 ended (it will be noted that end time 260 will not always be the time at which the bid containing winning price 258 was placed). It will be appreciated that for an ended auction, current price 254 and winning price 258 will be equal. For an auction that has not yet ended, winning price 258 and end time 260 will generally not contain data.

It will now be apparent that server 108 can host a plurality of auctions, each for a different item. Server 108 can therefore maintain in memory a plurality of auction records 250: one for each auction hosted at server 108. For each auction, server 108 can additionally receive a plurality of bid records 200 and compare received bid records in order to determine which bid record contains the current highest bid price.

Figure 3:
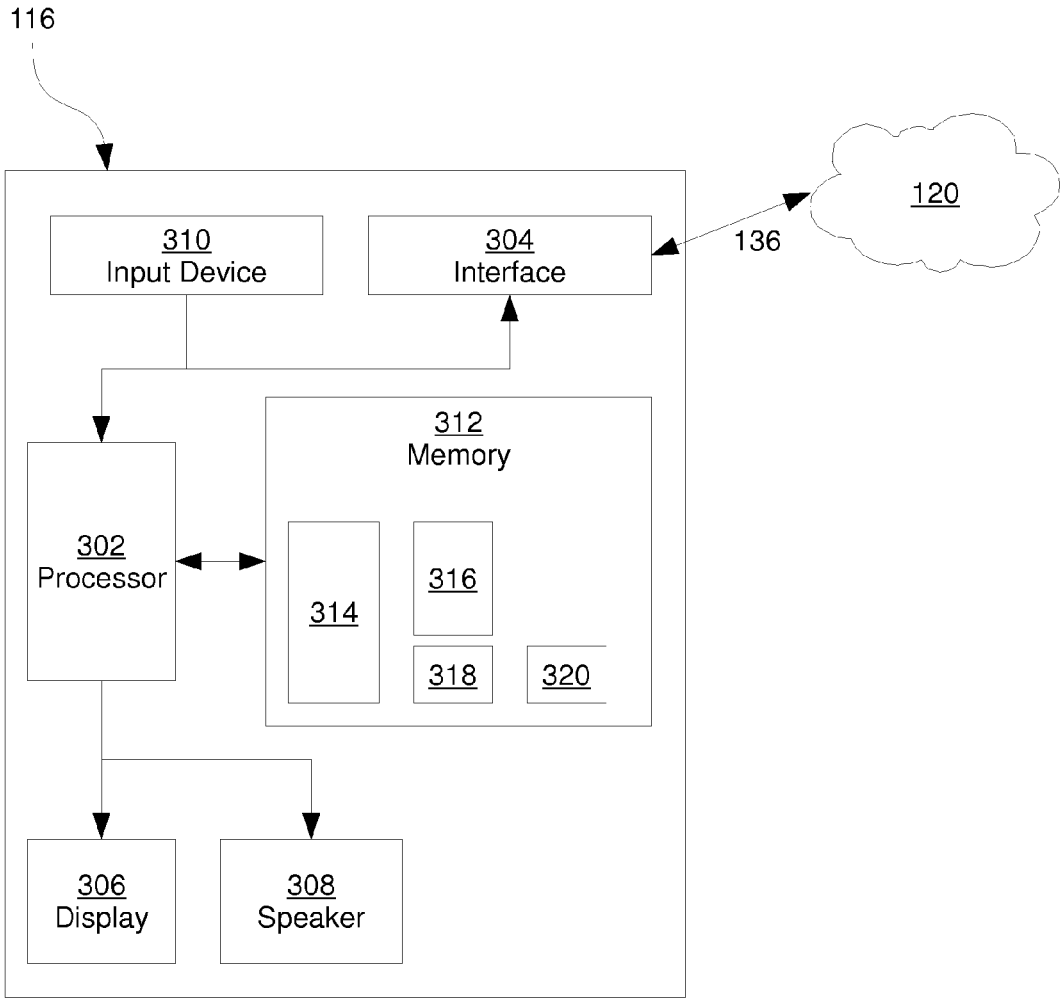
FIG. 3 depicts a schematic representation of the third server of FIG. 1, according to a non-limiting embodiment.

Referring now to FIG. 3, third server 116 is shown in greater detail. Third server 116 can be operated by an entity separate from those operating first and second servers 108 and 112, though it will be understood that this is not strictly necessary. For example, server 116 can be operated by a device service provider for mobile electronic devices 104. Server 116 can include a processor 302 (which can be one or more central processing units) interconnected with an interface 304 by way of a communication bus (not shown). Interface 304 provides wireless or wired communication capabilities, or both wireless and wired communication capabilities, to server 116 via link 136 and network 120 as discussed above. Server 116 can also include one or more output devices such as a display 306 and a speaker 308 interconnected with processor 302 via a communication bus. Server 116 can additionally include an input device 310 interconnected with processor 302 via a communication bus. Input device 310 can include any combination of a keyboard, a mouse, a touch screen integrated with display 306, a microphone and the like.

Server 116 also includes a memory 312 interconnected with processor 302. As mentioned above, memory 312 can comprise any suitable combination of volatile memory (e.g. random access memory ("RAM")) and persistent memory (e.g. read only memory ("ROM"), hard disk devices and the like). Memory 312 can maintain applications (not shown) comprising computer readable instructions for execution by processor 302 and for configuring processor 302 via such execution for performing various actions. It will be understood that such applications need not be maintained in memory 312. Applications can be stored on any suitable computer readable medium (e.g. a removable diskette, CD-ROM, USB drive and the like). The computer readable medium can also be located remotely to server 116 and the instructions can be transmitted to processor 302 via network 120, link 136 and interface 304.

Memory 312 can also maintain a bid tracking database 314 for maintaining records of winning bids placed from mobile electronic devices 104. A method of managing the bid tracking database 314 will now be described in connection with FIG. 4.

Figure 4:
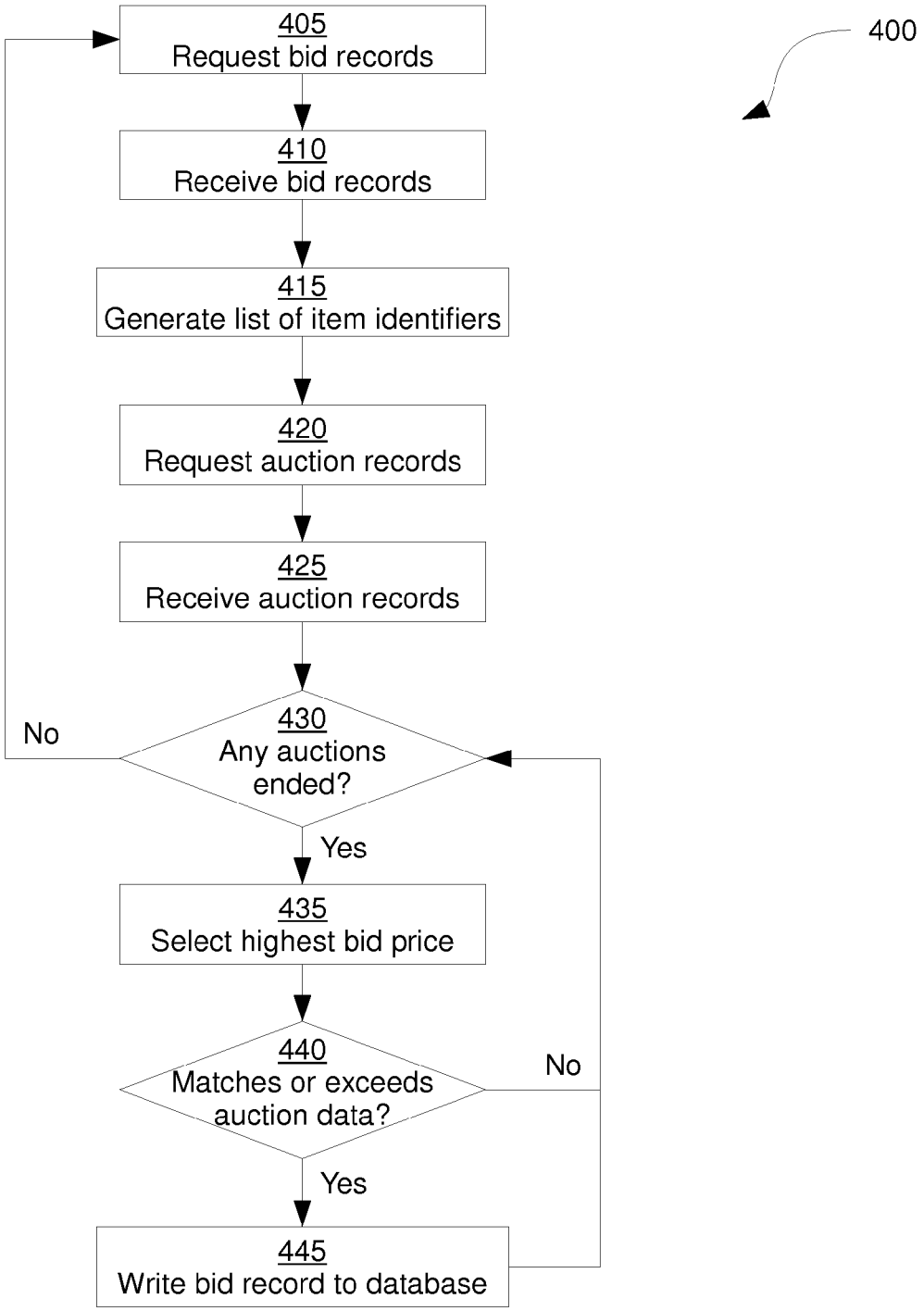
FIG. 4 depicts a method for managing a bid tracking database, according to a non-limiting embodiment.

FIG. 4 depicts a method 400 for managing bid tracking database 314. While method 400 will be described in conjunction with its performance on server 116, it will be understood that method 400 and server 116 need not be exactly as described herein.

Method 400 begins at block 405, at which processor 302 can be configured to transmit a request, via interface 304, link 136 and network 120, to second server 112 for bid records received at server 112 from mobile electronic devices 104. The request can be transmitted at pre-determined intervals of time. For example, the request can be transmitted once per week, and can request any bid records that have been received at server 112 since the previous request was transmitted.

Proceeding to block 410, processor 302 can be configured to receive the bid records requested at block 405 and to store the received records in memory 312. Referring briefly to FIG. 3, received records 316 are shown maintained within memory 312. It will be understood that received records 316 can comprise at least one bid record as described in conjunction with bid record 200 above. In some embodiments, as shown in FIG. 5, received records 316 can include a plurality of bid records, including bid record 200.

Having received bid records at block 410, method 400 proceeds to block 415, where processor 302 can be configured to generate a list of item identifiers from the bid records received at block 410. Referring again to FIG. 5, a list 318 of item identifiers is shown. It will now be apparent that list 318 comprises a list of unique item identifiers present in bid records 316. Although some item numbers are repeated within bid records 316 (that is, bid records 316 contain multiple bid records for the same item), list 318 does not contain any duplicated item identifiers.

Returning to FIG. 4, performance of method 400 continues at block 420, where processor 302 can be configured to transmit requests for auction records to first server 108 based on the contents of list 318. Processor 302 can be configured to transmit, via interface 304, a request for the auction record corresponding to each item identifier present in list 318.

Proceeding to block 425, processor 302 can be configured to receive auction records 320, as shown in FIG. 5, from first server 108. Auction records 320 can include one auction record, such as auction record 250, for each item identifier for which a request was transmitted at block 420. As can be seen in FIG. 5, auction records 320 can include auctions records for auctions that have not yet ended. Those auction records do not include data in the winning price and end time fields. Auction records 320, once received, can be maintained in memory 312 as shown in FIG. 3.

Method 400 then proceeds to block 430. At block 430, processor 102 can be configured to determine if any of auction records 320 contain data for auctions that have ended (i.e. for which a winning bid has been placed). In performing block 430, processor 302 can be configured to determine whether any of auction records 320 include winning prices and end times. For the exemplary auction records 320 shown in FIG. 5, the determination at block 430 would therefore be affirmative (the auction for item number 12345 has ended, while the remainder have not yet ended).

Having determined that at least one auction has ended, processor 302 can then be configured to perform block 435 of method 400. At block 435, processor 302 can be configured to select the bid record having the highest bid price from among the bid records in 316 having item identifiers corresponding to the item identifier of the ended auction. In the present exemplary performance of method 400, the ended auction is for item number 12345. There are two records within bid records 316 which have matching item numbers (specifically, the first and last of bid records 316). Thus, processor 302 can be configured to select the one of those two records with the highest bid price. As seen in FIG. 5, the final record of bid records 316 has a higher bid price ($72.00) than the first record ($70.00). The final record is therefore selected at block 435.

Proceeding to block 440, processor 302 can be configured to compare the bid price and timestamp of the bid record selected at block 435 with the winning price and end timestamp, respectively, of the ended auction. By way of the comparison, processor 302 can be configured to determine whether the bid price matches or exceeds the winning price and whether the bid timestamp matches the end timestamp. If both the above conditions are satisfied, the bid record selected at block 435 can be considered the winning bid for the ended auction. It will be understood by those skilled in the art that an exact match between the bid price and the winning price is not necessary for auctions where proxy bidding can be used. In such auctions, first server 108 can be configured to receive a bid record from a mobile electronic device 104 and gradually increment, as necessary (i.e. as other competing bids are received) an actual bid price for the relevant auction until the bid price from the bid record is reached. If the bid price is not reached, the current increment can be registered as the winning price, in favour the originating mobile electronic device 104. In such cases, the bid record from the mobile electronic device 104 will be the winning bid, despite the fact that its bid price can be higher than the winning price.

If the determination at block 440 is negative (that is, the bid price and timestamp do not match the winning price and end timestamp), method 400 proceeds to block 430 to check for further ended auctions, as a winning bid has not been located among bid records 316 for the current ended auction.

If, however, the determination at block 440 is affirmative, method 400 advances to block 445, where the bid record selected at block 435 is written to bid tracking database 314. In the present exemplary performance of method 400, as can be seen from FIG. 5, the winning price matches the highest bid price for item number 12345, and the end timestamp matches the timestamp for the highest bid. Thus, the determination at block 440 is affirmative and the $72.00 bid record for item number 12345 is written to bid tracking database 314.

Following performance of block 445, method 400 returns to block 430, where a determination is made as to whether any further ended auctions remain to be processed. In the present exemplary performance of method 400, auction records 318 contain only one record for an ended auction. The determination at block 430 is therefore negative, and method 400 returns to block 405. If the determination at block 430 were positive, blocks 435 and 440 would be repeated for the next ended auction, as described above.

It will be appreciated that following a negative determination at block 430, method 400 need not be immediately followed by a further performance of block 405. Performance of block 405 can be conducted at pre-determined intervals of time as discussed above, and thus block 405 may not be performed again until the pre-determined interval of time has elapsed in some embodiments.

It will now be apparent that variations can be made to the embodiments described above. For example, in some embodiments second server 112 can be omitted. In such embodiments mobile electronic devices 104 can be configured to transmit bid records to third server 116 rather than second server 112. In such embodiments block 405 can be omitted, as the bid records are already available at server 116.

As a further exemplary variation, in some embodiments auction records can include a single price field and a single timestamp field rather than two of each filed, as described above. In such embodiments, auction records can also include a flag, such as a field containing "yes" or "no," indicating whether or not the auction has ended. In performing the determination at block 430, processor 302 could thus be configured to determine whether any auction records included a "yes" flag.

In some embodiments, following completion of block 445 (or block 440, if the determination at block 440 is negative), records within bid records 316 having the item identifier of the ended auction that has been processed by the performance of blocks 440 and/or 445 can be deleted from bid records 316. In the exemplary performance of method 400 described above, the first and last records of bid records 316 would thus be deleted following the performance of block 445 for item number 12345.

Additionally, in some embodiments block 405 can be omitted entirely, as second server 112 can be configured to transmit bid records 316 to third server 116 without such records being requested.

In some embodiments (not shown), bid records 200 transmitted from mobile electronic devices 104 can include identifications of the entity or entities providing network service to mobile electronic devices 104 (that is, the operators of links 124-1, 124-2, . . . , **124-*n*). Such identifiers can be requested by third server 116 and added to bid tracking database 314** as described above.

Persons skilled in the art will appreciate that there are yet more alternative implementations and modifications possible for implementing the embodiments, and that the above implementations and examples are only illustrations of one or more embodiments. The scope, therefore, is only to be limited by the claims appended hereto.

What is claimed is:

1. A method of managing a bid tracking database at a first server, the method comprising:

receiving at least one bid record at an interface of the first server from a mobile electronic device via a second server, the at least one bid record comprising a bid price, a bid timestamp, and a bid item identifier;

receiving at least one auction record at the interface of the first server from a third server, the at least one auction record comprising a winning price, an end timestamp, and an auction item identifier corresponding to the bid item identifier, and the at least one auction record corresponding to an auction run by an auction website hosted at the third server;

maintaining, by the first server, the at least one bid record and the at least one auction record in a memory;

when the at least one auction record indicates that the auction has ended, determining, by the first server, whether the bid price matches or exceeds the winning price and whether the bid timestamp matches the end timestamp to identify the bid record corresponding to winning bid data included in the at least one auction record; and when the determination is affirmative, writing the bid record to the bid tracking database maintained in the memory.

2. The method of claim 1, further comprising:

receiving at the interface a plurality of bid records, at least two of the bid records having a common bid item identifier;

selecting, prior to the determination, the one of the at least two bid records having the highest bid price; and performing the determination based on the selected bid record.

3. The method of claim 1, further comprising:

prior to receiving the at least one bid record, transmitting a request for the at least one bid record.

4. The method of claim 3, wherein the transmitting of the request for the at least one bid record comprises transmitting at a pre-defined time interval after a previous request.

5. The method of claim 1, further comprising:

prior to receiving the at least one auction record, transmitting a request for the at least one auction record.

6. The method of claim 5, further comprising:

prior to transmitting the request for the at least one auction record, generating a list of item identifiers based on the received bid records.

7. The method of claim 1, further comprising:

receiving at the interface a plurality of auction records, each auction record having a different item identifier number; and repeating the determining and the writing for each auction record.

8. The method of claim 1, further comprising, after the writing of the bid record or at an end of an auction corresponding to the bid item identifier, deleting bid records received at the interface having the bid item identifier.

9. A first server, comprising:

an interface for receiving at least one bid record from a mobile electronic device via a second server, the at least one bid record comprising a bid price, a bid timestamp, and a bid item identifier; and for receiving at least one auction record from a third server, the at least one auction record comprising a winning price, an end timestamp, and an auction item identifier corresponding to the bid item identifier, and the at least one auction record corresponding to an auction run by an auction website hosted at the third server;

a memory for maintaining the at least one bid record and the at least one auction record, and for maintaining a bid tracking database; and a processor in communication with each of the interface and the memory, the processor configured to receive the at least one bid record and the at least one auction record from the interface; the processor further configured to determine, when the at least one auction record indicates that the auction has ended, whether the bid price matches or exceeds the winning price and whether the bid timestamp matches the end timestamp to identify the bid record corresponding to winning bid data included in the at least one auction record; and the processor further configured to, when the determination is affirmative, write the bid record to the bid tracking database maintained in the memory.

10. The first server of claim 9, the processor further configured to receive a plurality of bid records via the interface, at least two of the bid records having a common bid item identifier, and the processor further configured to select, prior to the determination, the one of the at least two bid records having the highest bid price, and to perform the determination based on the selected bid record.

11. The first server of claim 9, the processor further configured, prior to receiving the at least one bid record, to transmit a request via the interface for the at least one bid record.

12. The first server of claim 11, the processor further configured to transmit the request for the at least one bid record at a pre-defined time interval after a previous request.

13. The first server of claim 9, the processor further configured, prior to receiving the at least one auction record, to transmit a request via the interface for the at least one auction record.

14. The first server of claim 13, the processor further configured to generate a list of item identifiers based on the received bid records prior to transmitting the request for the at least one auction record.

15. The first server of claim 9, the processor further configured to receive a plurality of auction records via the interface, each auction record having a different item identifier number, and the processor further configured to repeat the determination and writing for each auction record.

16. The first server of claim 9, the processor further configured to, after the writing of the bid record or at an end of an auction corresponding to the bid item identifier, delete bid records received at the interface having the bid item identifier.

17. A non-transitory computer readable medium including instructions, when executed by a processor included in a first server, causes the processor to perform operations comprising:

receiving at least one bid record at an interface of the first server from a mobile electronic device via a second server, the at least one bid record comprising a bid price, a bid timestamp, and a bid item identifier;

receiving at least one auction record at the interface from a third server, the at least one auction record comprising a winning price, an end timestamp, and an auction item identifier corresponding to the bid item identifier, and the at least one auction record corresponding to an auction run by an auction website hosted at the third server;

maintaining the at least one bid record and the at least one auction record in a memory;

when the at least one auction record indicates that the auction has ended, determining whether the bid price matches or exceeds the winning price and whether the bid timestamp matches the end timestamp to identify the bid record corresponding to winning bid data included in the at least one auction record; and when the determination is affirmative, writing the bid record to the bid tracking database maintained in the memory.

18. The non-transitory computer readable medium of claim 17, further comprising, after the writing of the bid record or at an end of an auction corresponding to the bid item identifier, deleting bid records received at the interface having the bid item identifier.

19. The non-transitory computer readable medium of claim 17, further comprising:

receiving at the interface a plurality of bid records, at least two of the bid records having a common bid item identifier;

selecting, prior to the determination, the one of the at least two bid records having the highest bid price; and performing the determination based on the selected bid record.

20. The non-transitory computer readable medium of claim 17, further comprising:

receiving at the interface a plurality of auction records, each auction record having a different item identifier number; and repeating the determining and the writing for each auction record.

* * * * *